US006520406B1

(12) United States Patent
Gibson

(10) Patent No.: US 6,520,406 B1
(45) Date of Patent: Feb. 18, 2003

(54) ROOM SECURITY SYSTEM

(76) Inventor: Kim Gibson, 304 E. 18th. St., Scottsbluff, NE (US) 69341

( * ) Notice: Subject to any disclaimer, the term of this patent is extended or adjusted under 35 U.S.C. 154(b) by 0 days.

(21) Appl. No.: 09/476,353

(22) Filed: Jan. 3, 2000

(51) Int. Cl.[7] ..... G06C 1/00; A44C 23/00; A63B 71/06; A63F 1/18

(52) U.S. Cl. ..... 235/123; 235/61 R

(58) Field of Search ..... 235/61 R, 91 R; 340/545.1, 545.7, 545.8, 568.1, 573.1; 70/436

(56) References Cited

U.S. PATENT DOCUMENTS

| | | | | | |
|---|---|---|---|---|---|
| 3,981,164 | A | * | 9/1976 | Balducci | 70/214 |
| 4,107,968 | A | * | 8/1978 | Schlage | 70/436 |
| 5,006,697 | A | * | 4/1991 | Amis et al. | 235/91 R |
| 5,138,656 | A | * | 8/1992 | Shanes | 379/167 |
| 5,410,900 | A | * | 5/1995 | Mattingly | 70/436 |
| 6,027,149 | A | * | 2/2000 | Kosky | 292/307 R |

* cited by examiner

*Primary Examiner*—Karl D. Frech
*Assistant Examiner*—Lisa M. Caputo
(74) *Attorney, Agent, or Firm*—Edwin H. Crabtree; Ramon L. Pizarro; Donald W. Margolis

(57) ABSTRACT

A room security system for providing an occupant of a room information as to the number of times a person has entered and exited the room. The security system displays a visual numerical count. The numerical count allows a viewer to determine if there has been an unauthorized entry and exit when the room has been thought to be unoccupied. The security system includes a counter housing for mounting on a door frame. The door frame surrounding a door. The counter housing includes a housing window opening in a front of the housing. Also, the counter housing includes a mechanical counter received therein. The counter is incased inside the housing using an epoxy filler material to prevent the counter from being removed, reset or tampered with while installed inside the housing. The mechanical counter includes a display window with a series of counter numbers. The counter also includes an outwardly extending trigger. When the trigger is depressed and released, the counter numbers are advanced by a count of "one". The security system also includes a "L" shaped trigger plate. The trigger plate has a horizontal mounting base and an upwardly extending vertical bracket. The mounting base is adapted for attaching to a portion of the door. The bracket includes a bracket opening which is indexed with the counter display window opening when the door is closed. Also, a portion of the bracket is used to engage an end of the trigger and depress the trigger.

6 Claims, 1 Drawing Sheet

ROOM SECURITY SYSTEM

BACKGROUND OF THE INVENTION (a) Field of the Invention

This invention relates to a security system and more particularly, but not by way of limitation, to a room security system for monitoring the entry and exit of people entering the room through a door and in particular monitor the entry and exit of unauthorized people entering the room.

(b) Discussion of Prior Art

In U.S. Pat. No. 5,705,982 to Faltings, an intrusion detection, register and indication apparatus is described. The apparatus is used for detecting intrusions into spaces of various kinds such as apartments, offices, etc. In U.S. Pat. No. 5,138,638 to Frey, a system is disclosed for counting the number of shoppers that enter a retail store and processing this information. In U.S. Pat. No. 4,278,968 to Arnett et al., a door status detector is described. The detector creates a signal when the door has remained open for a predetermined amount of time. In U.S. Pat. No. 5,831,533 to Kanno, a entering/leaving control system is disclosed for a person carrying a wireless medium that collects information.

None of the above mentioned patents specifically disclose the novel structure and function of the subject mechanical room security system for mounting on an existing door and door frame. The system used for monitoring unauthorized entry into and exiting of a room.

SUMMARY OF THE INVENTION

In view of the foregoing, it is a primary object of the subject invention to provide a room security system wherein an occupant of a room continually has information as to the number of times a person has entered and exited the room.

Another of object of the invention is to display a visual numerical count. The numerical count allows a viewer to determine if there has been an unauthorized entry and exit when the room has been thought to be unoccupied.

Still another object of the room security system is it can be quickly mounted to an existing door and door frame for monitoring the entry and exiting of the room. The security system is simple in design, rugged in construction, requires little or no maintenance and operates at no cost.

The security system includes a counter housing for mounting on a door frame. The door frame surrounding a door. The counter housing also includes a housing window opening in a front of the housing. Also, the counter housing includes a mechanical counter received through an open back of the housing. The counter is incased inside the housing using an epoxy filler material to prevent the counter from being removed, reset or tampered with while installed inside the housing. The mechanical counter includes a display window with a series of counter numbers. The display window is indexed with the housing window opening in the front of the housing. The counter also includes an outwardly extending trigger. A portion of the trigger is received through the front of the housing. When the trigger is depressed and released, the counter numbers are advanced by a count of "one".

The security system also includes an "L" shaped trigger plate. The trigger plate has a horizontal mounting base and an upwardly extending vertical bracket. The mounting base is adapted for attaching to a portion of the door. The bracket includes a bracket opening which is indexed with the housing window opening and the counter display window when the door is closed. Also, a portion of the bracket is used to engage an end of the trigger and depress the trigger when the door is closed.

When the door is opened, the bracket is removed from the end of the trigger. At this time, the trigger is released and the counter numbers advance by a count of "one". By tracking the counter numbers, the viewer can determine if there has been a trespass when he or she has been absent from the room.

These and other objects of the present invention will become apparent to those familiar with the different types of mechanical security systems for monitoring unauthorized entrances into a room when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
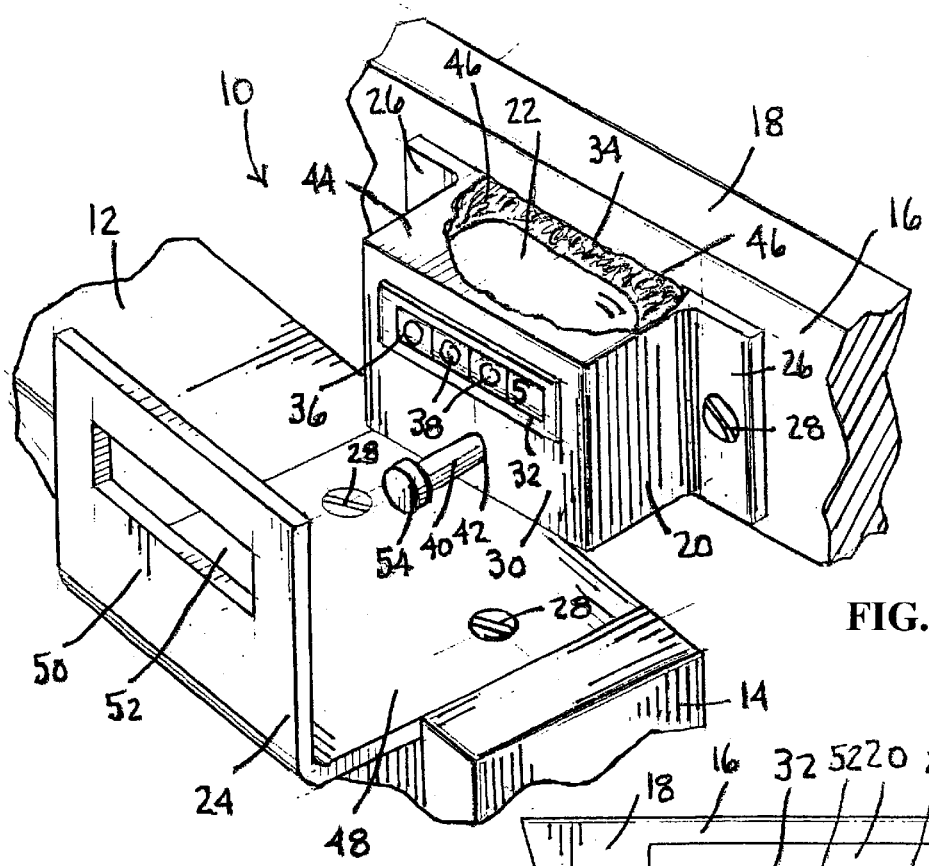
FIG. 1 illustrates a perspective view of the subject security system mounted on a top of a door and on a side of a door frame. The door is shown partially open with a counter housing mounting on the door frame. The door is shown with a "L" shaped trigger plate mounted on a portion of the top of the door.

In FIG. 1 a perspective view of the subject room security system is shown and having a general reference numeral 10. The system 10 is adapted for mounting a top 12 of a door 14 and on a side 16 of a door frame 18. While the system 10 is shown mounted on the top of the door 14 and on the door frame 18, it should be kept in mind that the security system can be mounted in various ways to different types of windows, window frames, doors and door frames without departing from the spirit and scope of the invention.

Broadly, the security system 10 includes a counter housing 20, a mechanical counter 22 and an "L" shaped trigger plate 24. The counter housing 20 includes a pair of outwardly extending flanges 26 with holes therein for receiving wood screws 28. The wood screws 28 are used for securing the housing 20 to the door frame 18. The housing 20 also includes a front portion 30 with a housing window opening 32 and an open back portion 34 received next to the side of the door frame 18.

The mechanical counter 22 includes a display window 36 with a series of counter numbers 38. In this example, the count is shown as "5". The display window 36 is indexed in front of the housing window opening 32. The counter 22 also includes an outwardly extending trigger 40. A portion of the trigger 40 is shown received through a hole 42 in the front portion 30 of the counter housing 22. Note in this drawing, a top portion 44 of the housing has been cut-away to expose the counter 22 received inside the housing. The counter 22 is incased inside the housing 20 with an epoxy filler material 46 to prevent the counter 22 from being removed, reset or tampered with while installed in the counter housing 22.

The "L" shaped trigger plate 24 includes a horizontal mounting base 48 and an upwardly extending vertical bracket 50. The mounting base 48 includes a pair of holes therein for receiving a pair of wood screws 28. The wood screws 28 are used for attaching the trigger plate 24 to the top 12 of the door 14.

The vertical bracket 50 includes a bracket opening 52 therein which is indexed with the housing window opening 32 and the counter display window 36 when the door 12 is in a closed position. Also, a portion of the bracket 50 is used to engage an end 54 of the trigger 40 and depress the trigger when the door is closed.

Figure 2:
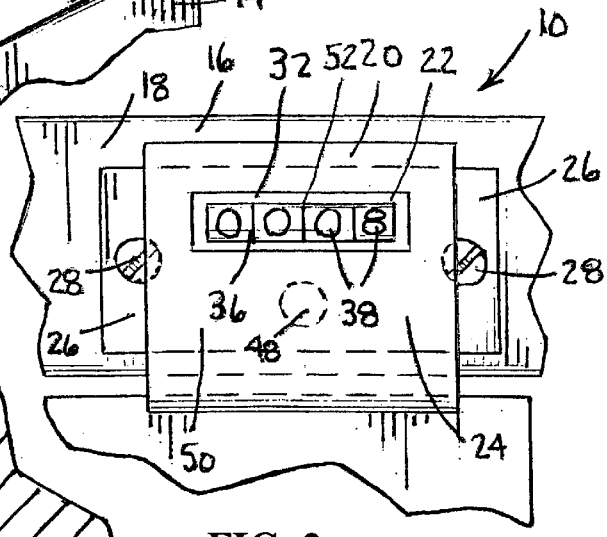
FIG. 2 illustrates a front view of the counter housing having a mechanical counter mounted therein. The counter includes a display window and a series of counter numbers. The count is shown as "8" The counter also includes an outwardly extending trigger.

In FIG. 2, a front view of the room security system 10 is shown. In this view, the display window 36 with counter numbers 38 are shown indexed with the housing window opening 32 and the bracket opening 52 in the vertical bracket 50. In this drawing, the counter 22 shows a count of "8".

Figure 3:
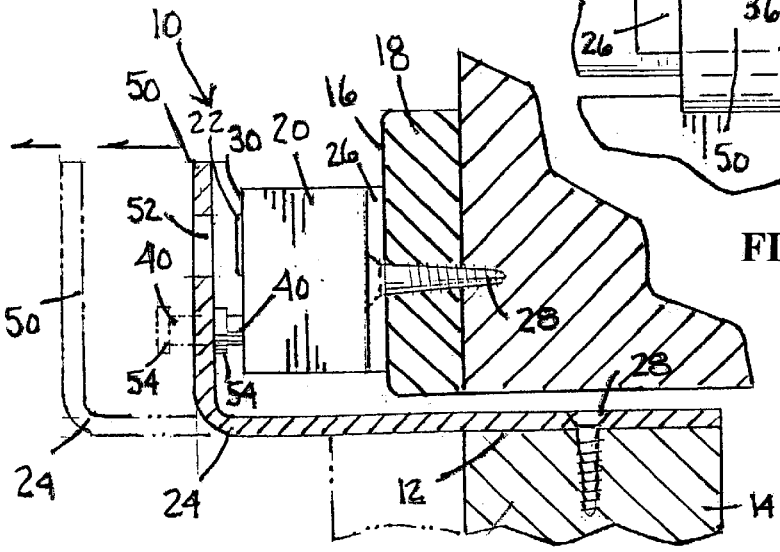
FIG. 3 illustrates a side view of the security system. In this view, the door has been closed and the "L" shaped trigger plate has engaged and depressed the trigger of the counter.

In FIG. 3, a side view of the security system 10 is shown. In this view, the door 14 has been closed and a portion of the "L" shaped trigger plate 24 has engaged and depressed the trigger 40 of the counter 22 mounted inside the counter housing 20. When the trigger 40 is depressed and then released, the counter numbers 38 are advanced by a count of "one". When the door 14 is opened, the vertical bracket 50 is removed from the end 54 of the trigger 40 as shown in dotted lines. At this time, the trigger 40 is released and the counter numbers 38 advance by a count of "one".

By tracking the counter numbers 38, the viewer can determine if there has been a trespass when he or she has been absent from the room. For example, when the count is "5" as shown in FIG. 1 and when the viewer leaves the room and returns and closes the door, the count on the counter should be "6". But, if the viewer of the security system 10 leaves the room and returns and closes the door, the count on the counter is "8", there may or may not have been two unauthorized entrees and exits of the room. In this manner, the occupant of the room using the subject invention can monitor the number of times a person has entered and exited the room.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A room security system for providing an occupant of room information as to a number of times a person has entered and exited a room, the security system adapted for mounting on a door and a door frame, the security system comprising:

a counter housing, said counter housing adapted for mounting on the door frame, said counter housing having a housing window opening in a front thereof, a mechanical counter received inside said counter housing, said counter incased inside said counter housing using an epoxy filler material to prevent said counter from being removed, reset or tampered with while installed inside said counter housing, said counter having a counter display window with a series of counter numbers, said counter display window indexed with the housing window opening, said counter having an outwardly extending trigger; and an "L" shaped trigger plate, said trigger plate having a horizontal mounting base and an upwardly extending vertical bracket, said mounting base adapted for attaching to a portion of the door, said vertical bracket having a bracket opening therein, said bracket opening indexed with said counter display window when the door is closed, a portion of said bracket used to engage an end of said trigger and depress said trigger.

2. A room security system for providing an occupant of room information as to a number of times a person has entered and exited a room, the security system adapted for mounting on a door and a door frame, the security system comprising:

a counter housing, said counter housing adapted for mounting on the door frame;

a mechanical counter received inside said counter housing, said counter having a counter display window with a series of counter numbers, said counter having an outwardly extending trigger; and an "L" shaped trigger plate, said trigger plate having a horizontal mounting base adapted for attaching to a portion of the door and an upwardly extending vertical bracket having a bracket opening therein, said bracket opening indexed with said counter display window when the door is closed, a portion of said trigger plate used to engage an end of said trigger for depressing said trigger.

3. The security system as described in claim 2 wherein said counter housing includes a housing window opening in a front thereof, said counter display window disposed in front of said housing window opening.

4. The security system as described in claim 2 wherein said mechanical counter is incased inside said counter housing using an epoxy filler material to prevent said counter from being removed, reset or tampered with while installed inside said counter housing.

5. A room security system for providing an occupant of room information as to a number of times a person has entered and exited a room, the security system adapted for mounting on a door and a door frame, the security system comprising:

a counter housing, said counter housing adapted for mounting on the door frame;

a mechanical counter received inside said counter housing, said counter incased inside said counter housing using an epoxy filler material to prevent said counter from being removed, reset or tampered with while installed inside said counter housing, said counter having a counter display window with a series of counter numbers, said counter having an outwardly extending trigger; and an "L" shaped trigger plate, said trigger plate having a horizontal mounting base adapted for attaching to a portion of the door and an upwardly extending vertical bracket having a bracket opening therein, said bracket opening indexed with said counter display window when the door is closed, a portion of said bracket used to engage an end of said trigger and depress said trigger.

6. The security system as described in claim 5 wherein said counter display window is indexed with a housing window opening in said counter housing.

* * * * *